US010111527B2

(12) United States Patent
Jin

(10) Patent No.: US 10,111,527 B2
(45) Date of Patent: Oct. 30, 2018

(54) BENDABLE PANEL FOR FURNITURE AND SOFA HAVING SAME

(71) Applicant: Xiamen Innovation Metal Products Co., Ltd., Xiamen (CN)

(72) Inventor: Juyoung Jin, Xiamen (CN)

(73) Assignee: Xiamen Innovation Metal Products Co., LTD., Xiamen (CN)

( * ) Notice: Subject to any disclaimer, the term of this patent is extended or adjusted under 35 U.S.C. 154(b) by 0 days.

(21) Appl. No.: 15/601,795

(22) Filed: May 22, 2017

(65) Prior Publication Data

US 2017/0340119 A1 Nov. 30, 2017

(30) Foreign Application Priority Data

May 26, 2016 (CN) ..... 2016 1 0354760
May 26, 2016 (CN) ..... 2016 2 0487839 U
May 26, 2016 (CN) ..... 2016 2 0487840 U
May 26, 2016 (CN) ..... 2016 2 0487841 U

(51) Int. Cl.
*A47C 7/16* (2006.01)
*A47C 4/02* (2006.01)

(52) U.S. Cl.
CPC ..... *A47C 7/16* (2013.01); *A47C 4/021* (2013.01)

(58) Field of Classification Search
CPC .. A47C 7/16; A47C 7/40; A47C 4/021; A47C 4/00; A47C 4/02; A47C 17/86
USPC ..... 297/440.12–440.13
See application file for complete search history.

(56) References Cited

U.S. PATENT DOCUMENTS 2,806,514 A * 9/1957 Smith ..... A47C 5/005 297/440.12
4,398,902 A * 8/1983 Mangum ..... B65D 5/0095 206/326
4,561,706 A * 12/1985 Grati ..... A47B 43/02 108/51.3
4,676,383 A * 6/1987 Sheffer ..... A47F 5/112 211/135
4,811,987 A * 3/1989 Volpe ..... A47C 5/005 248/174
4,926,759 A * 5/1990 Vitsky ..... A47B 47/06 108/180
7,051,919 B1 * 5/2006 Walsh ..... B65D 5/0005 229/101.1
9,205,947 B1 * 12/2015 Waldschmidt ..... B65D 5/32
2003/0146272 A1 * 8/2003 Kent ..... B65D 5/0015 229/171
2004/0108434 A1 * 6/2004 Olvey ..... B65D 19/0036 248/346.02
2005/0071919 A1 * 4/2005 Kenan ..... A47C 4/021 5/93.1
2008/0086952 A1 * 4/2008 Holwick ..... E04G 21/30 52/3

(Continued)

*Primary Examiner* — Mark R Wendell
(74) *Attorney, Agent, or Firm* — Morgan, Lewis & Bockius LLP

(57) ABSTRACT

Disclosed are bendable panels for furniture, and sofa frames and sofas composed of bendable panels. A bendable panel for furniture includes a panel formed with one or more bending lines. The one or more bending lines divide the panel into a panel body and one or more panel extensions. A respective panel extension in the one or more panel extensions is bendable with respect to the panel body along a corresponding bending line in the one or more bending lines between a first angle and a second angle.

36 Claims, 20 Drawing Sheets

(56) References Cited

U.S. PATENT DOCUMENTS

| | | | | |
|---|---|---|---|---|
| 2009/0057387 | A1* | 3/2009 | Tirado Alanis | B65D 5/2057 229/145 |
| 2009/0313902 | A1* | 12/2009 | Brisbois | E06B 3/88 49/460 |
| 2014/0026378 | A1* | 1/2014 | Gessel | A61G 17/0073 27/4 |
| 2015/0174504 | A1* | 6/2015 | Berglund | A63H 33/42 472/136 |
| 2015/0223606 | A1* | 8/2015 | Gerstle | A47C 5/005 297/452.1 |
| 2017/0234347 | A1* | 8/2017 | Rotholz | F16B 12/46 248/174 |

* cited by examiner

BENDABLE PANEL FOR FURNITURE AND SOFA HAVING SAME

CROSS-REFERENCE TO RELATED APPLICATIONS

The present application claims priority of Chinese Invention Application CN 201610354760.1 filed May 26, 2016, and Chinese Utility Model Applications CN 201620487839.7 filed May 26, 2016, CN 201620487840.X filed May 26, 2016, and CN 201620487841.4 filed May 26, 2016, the disclosure of each application is incorporated herein for all purposes by reference.

FIELD OF THE INVENTION

The present invention generally relates to panels, sofa frames and sofas. More particularly, the present invention relates to bendable panels, and sofa frames and sofas having such bendable panels.

BACKGROUND

Most of furniture currently available on the market is made of wood. For instance, a typical sofa is made of wood panels coupled to each other by nails or screws. Such furniture consumes a tremendous amount of wood, and thus unfriendly to the environment. Nails and/or splinters of the wood panels also pose threats to the safety of workers. Moreover, woods require preprocessing and thus increase the manufacturing cost of the furniture. Further, woods can be affected by environmental conditions such as moisture, and thus shorten the usable life span of the furniture. In addition, some wood panels tend to bounce back when bent, making the assembling and disassembling of the furniture difficult and inefficient.

Given the current state of the art, there remains a need for bendable panels, sofa frames and sofas that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides bendable panels for furniture, and sofa frames and sofas that are easy and convenient to assemble and disassemble with a lower cost.

In various exemplary embodiments, the present invention provides a bendable panel for furniture including a panel formed with one or more bending lines. The one or more bending lines divide the panel into a panel body and one or more panel extensions. The respective panel extension in the one or more panel extensions is bendable with respect to the panel body along a corresponding bending line in the one or more bending lines between a first angle and a second angle.

In some exemplary embodiments, the panel is formed with up to four bending lines, which divide the panel into the panel body and up to four panel extensions. In an exemplary embodiment, the panel or the panel body is hollow. In an exemplary embodiment, the panel is molded by a drawing or blowing process. In an exemplary embodiment, the panel body has a substantially rectangular shape. In an exemplary embodiment, the respective panel extension is bendable with respect to the panel body along the corresponding bending line between approximately 0 degree and 90 degrees.

In many exemplary embodiments, the corresponding bending line includes a plurality of slits. Adjacent slits are spatially separated from each other. Each slit in the plurality of slits includes a plurality of slots. Adjacent slots in the plurality of slots are connected to each other at their ends. When the respective panel extension is bent with respect to the panel body along the corresponding bending line at the second angle, the respective panel extension and the panel body include one or more inter-fitted protrusions and recesses, with the upper or lower surface of the panel at a respective protrusion abutting a bottom surface of a corresponding recess.

In some exemplary embodiments, a respective slit in the plurality of slits includes a first slot, a second slot, a third slot, a fourth slot and a fifth slot. The first, second and third slots are arranged at intervals. The fourth slot is disposed between the first and second slots, and having a first end connected to a first end of the first slot and a second end connected to a first end of the second slot. The fifth slot is disposed between the second and third slots, and having a first end connected to a second end of the second slot and a second end connected to a second end of the third slot. In an exemplary embodiment, the first slot, the second slot and the third slot are substantially parallel to each other. The fourth slot is substantially perpendicular to the first slot and the second slot. The fifth slot is substantially perpendicular to the second slot and the third slot.

In some exemplary embodiments, the respective slit in the plurality of slits is adjacent to a side of the panel, and further includes a sixth slot. The sixth slot has a first end connected to a second end of the first slot and a second end extended to the side of the panel. In an exemplary embodiment, the sixth slot is substantially aligned with the fifth slot. In an exemplary embodiment, the sixth slot has a length less than the sum of a distance between two adjacent slits and a length of the fourth slot.

In some exemplary embodiments, the respective slit in the plurality of slits is adjacent to a side of the panel, and is truncated. In an exemplary embodiment, a distance of the next adjacent slit to the side of the panel is equal to or less than a distance between the first slots of two adjacent slits.

In some exemplary embodiments, the respective slit in the plurality of slits further includes a seventh slot having a first end connected to a first end of the third slot. In an exemplary embodiment, the seventh slot is substantially parallel to the fourth or fifth slot. In an exemplary embodiment, the seventh slot has a length shorter than that of the fourth or fifth slot.

In an exemplary embodiment, lengths of the first slot, the second slot and the third slot are substantially the same, and lengths of the fourth slot and the fifth slot are substantially the same. In an exemplary embodiment, lengths of the first slot and the second slot are substantially the same, and a length of the third slot is different than the lengths of the first slot and the second slot.

In some exemplary embodiments, a respective slit in the plurality of slits includes three slots collectively forming a substantially ⊔-shaped slit. In an exemplary embodiment, the plurality of slits includes two or more substantially ⊔-shaped slits, with openings of adjacent ⊔-shaped slits facing the same direction. In an exemplary embodiment, the plurality of slits includes two or more substantially ⊔-shaped slits, with openings of adjacent ⊔-shaped slits facing opposite directions.

In some exemplary embodiments, the corresponding bending line is a crease. In an exemplary embodiment, the one or more bending lines include a first crease, two second creases, a third crease, or any combination of the first crease, the two second creases, and the third crease. The first crease, the two second creases, and the third crease divide the panel into the panel body, a first panel extension, two second panel extensions, and a third panel extension.

In various exemplary embodiments, the present invention provides a sofa including a lower frame and a bendable panel coupled to the lower frame. The lower frame has a front side, a rear side, a left side and a right side. The bendable panel includes a panel body and a first panel extension divided by a first bending line. The panel body serves as a seat panel of the sofa. The first panel extension is bent downward with respect to the panel body along the first bending line, and has a side fixedly connected to the front side of the lower frame.

In an exemplary embodiment, the first bending line includes a plurality of slits disclosed herein.

In some exemplary embodiments, the sofa further includes a left side panel, a right side panel, and a back panel. The left side panel is disposed above the lower frame and has a bottom side fixedly connected to the left side of the lower frame. The right side panel is disposed above the lower frame and has a bottom side fixedly connected to the right side of the lower frame. The back panel is disposed above and at the rear side of the lower frame. The back panel has a left side connected to the left side panel and a right side connected to the right side panel.

In some exemplary embodiments, the panel body includes a left side coupled to the left side panel, a right side coupled to the right side panel, and a rear side coupled to the back panel. The back panel has a left side coupled to the left side panel and a right side coupled to the right side panel. In an exemplary embodiment, the panel body includes a first plurality of snap blocks at each of a left side and a right side of the panel body, and each of the left and right side panels includes a first plurality of receiving openings arranged laterally at a lower portion of the left or right side panel to couple with the first plurality of snap blocks formed at the left or right side of the panel body. The back panel includes a second plurality of snap blocks at each of a left side and a right side of the back panel, and each of the left and right side panels includes a second plurality of receiving openings arranged vertically at a rear portion of the left or right side panel to couple with the second plurality of snap blocks formed at the left or right side of the panel body. The panel body includes a third plurality of snap blocks at a rear side of the panel body, and the back panel includes a third plurality of receiving openings arranged laterally at a lower portion of the back panel to couple with the third plurality of snap blocks of the panel body. In an exemplary embodiment, a respective receiving opening in the first or third plurality of receiving openings includes an inner protrusion, and a corresponding snap block in the first or third plurality of snap blocks includes a groove to receive the inner protrusion, thereby preventing unintentional disengagement of the left, right or back panel from the panel body.

In some exemplary embodiments, the first bending line is a crease.

In an exemplary embodiment, the bendable panel further includes two second bending lines dividing the panel into the panel body and two second panel extensions. Each of the two second panel extensions is bent upward and serves as a left or right side panel of the sofa. In an exemplary embodiment, the bendable panel further includes a third bending line dividing the panel into the panel body and a third panel extension. The third panel extension is bent upward and serves as a back panel of the sofa. In an exemplary embodiment, the bendable panel further includes two second bending lines dividing the panel into the panel body and two second panel extensions, and a third bending line dividing the panel into the panel body and a third panel extension. Each of the two second panel extensions is bent upward and serves as a left or right side panel of the sofa, and the third panel extension is bent upward and serves as a back panel of the sofa. The third panel extension is coupled to each of the two second panel extensions through receiving openings and snap blocks.

The bendable panels, sofa frames and sofas of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

DETAILED DESCRIPTION

Figure 1:
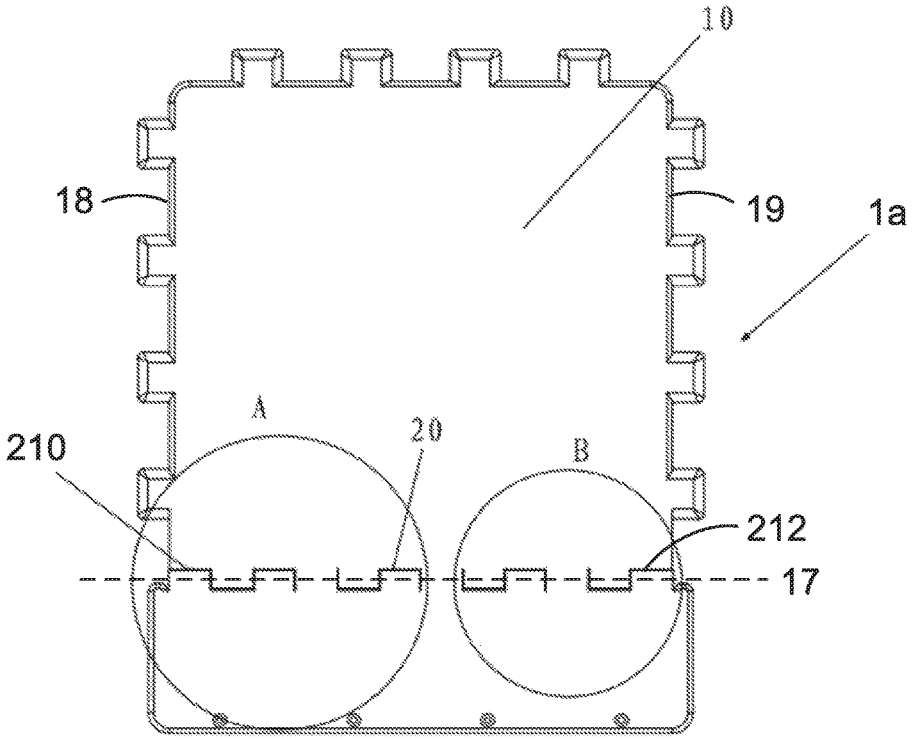
FIG. 1 is a schematic front view illustrating an exemplary bendable panel in accordance with a first exemplary embodiment of the present invention.

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of bendable panels for furniture, and sofa frames and sofas made of such bendable panels. Generally, a bendable panel of the present invention includes a panel formed with one or more bending lines. The panel can be made of any suitable materials including but not limited to woods and plastics. If made of plastics, the panel can be molded, for instance, by a blowing or drawing process. The panel or a portion of the panel can be solid or hollow, for instance, to have one or more cavities to save material and reduce weight.

The panel can be formed with any suitable number of bending lines, including but not limited to one, two, three, or four bending lines. Bending lines can be the same as or different from each other in terms of types, configurations or other factors. The one or more bending lines divide the panel into a panel body and one or more panel extensions of any suitable shapes. Each bending line allows a respective panel extension to bend with respect to the panel body independently. The bending directions and angles of the one or more panel extensions can be the same as or different from each other.

The bendable panels of the present invention are suitable for making any suitable furniture including but not limited to sofas, tables and chairs. For instance, a bendable panel of the present invention can be coupled to a lower frame to make a sofa. In various cases, the bendable panel includes a panel body and a first panel extension divided by a first bending line. The panel body serves as a seat panel of the sofa, while the first panel extension is bent downward with respect to the panel body along the bending line, and has a side fixedly connected to a front side of the lower frame. In many cases, the lower frame of the sofa has front, rear, left and right sides, and the panel body has a polygonal shape such as a substantially rectangular shape.

Figure 5:
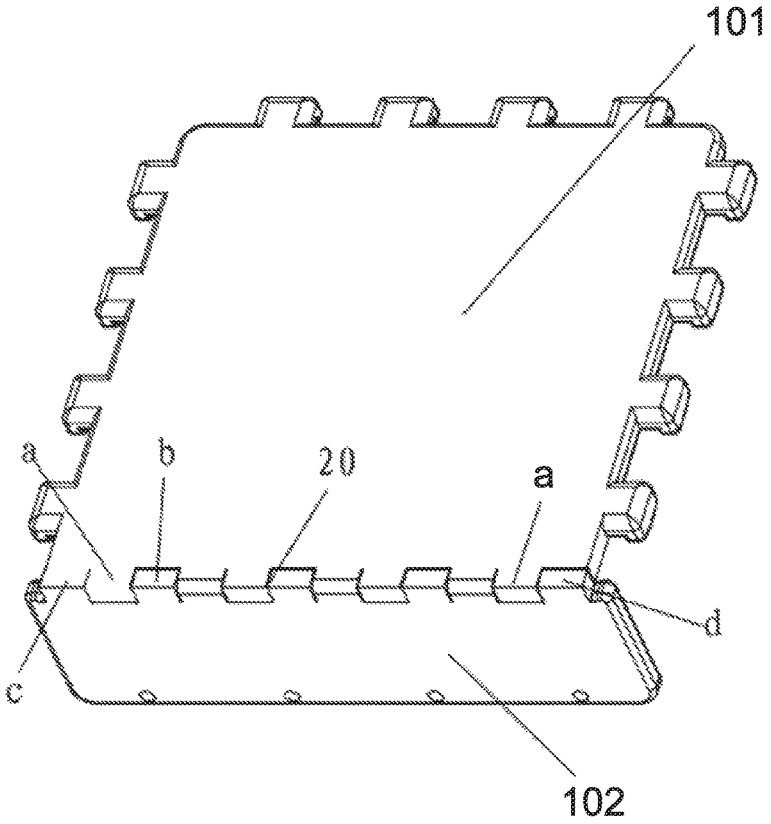
FIG. 5 is a schematic perspective view illustrating the exemplary bendable panel of FIG. 1 in a bent state.

Referring now to FIGS. 1 and 5, there is depicted exemplary bendable panel 1*a* for furniture in accordance with some exemplary embodiments of the present invention. By way of example, exemplary bendable panel 1*a* includes a panel such as panel 10 and one bending line such as bending line 17. Panel 10 has an upper surface (the surface facing toward the reader in FIG. 1) and a lower surface (the surface facing away from the reader in FIG. 1). Bending line 17 divides panel 10 into a panel body such as panel body 101 and a panel extension such as panel extension 102. Bending line 17 allows panel extension 102 to bend with respect to panel body 101 upwardly, downwardly, or both upwardly and downwardly between a first angle and a second angle. In an exemplary embodiment, bending line 17 allows panel extension 102 to bend between approximately 0 degree (e.g., when the panel extension is leveled with the panel body), and approximately 90 degrees (e.g., when the panel extension is substantially perpendicular to the panel body).

In some exemplary embodiments, bending line 17 includes a plurality of slits intermittently disposed (e.g., adjacent slits are spatially separated from each other) across the panel from one side (e.g., first side 18) to another side (e.g., first side 19). Slits can be the same as or different from each other. In many cases, each slit in the plurality of slits includes a plurality of slots, of which adjacent slots are connected to each other at their corresponding ends. A slit can include any suitable number of slots such as two, three, four, five, six or more than six slots, and the slots can be arranged to form any suitable shapes. In some cases, a slot is a through-cut cutting through the panel from the upper surface to the lower surface of the panel. When panel extension 102 is bent with respect to panel body 101 along bending line 17 at the second angle, panel extension 102 and panel body 101 include one or more inter-fitted protrusions and recesses, with the upper or lower surface of the panel at a respective protrusion abutting a bottom surface of a corresponding recess.

Figure 2:
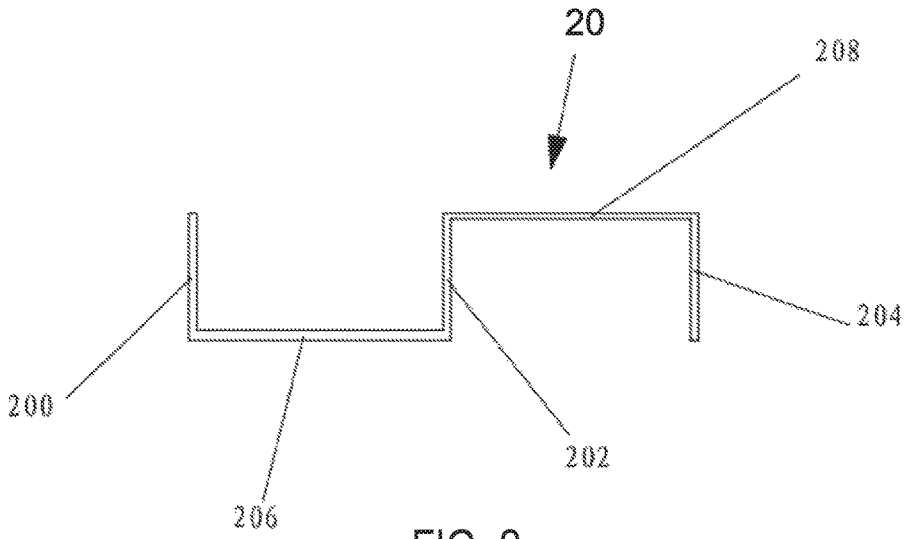
FIG. 2 is a schematic view illustrating an exemplary slit in accordance with some exemplary embodiments of the present invention.

For instance, FIGS. 1, 2 and 5 illustrate bending line 17 including a plurality of slits such as slits 20 intermittently disposed across the panel from first side 18 to second side 19. Slit 20 includes five slots, e.g., first slot 200, second slot 202, third slot 204, fourth slot 206 and fifth slot 208. The first, second and third slots are arranged at intervals (not necessarily the same interval). The fourth slot is disposed between the first and second slots, and has a first end connected to a first end of the first slot and a second end connected to a first end of the second slot. The fifth slot is disposed between the second and third slots, and has a first end connected to a second end of the second slot and a second end connected to a second end of the third slot.

In some exemplary embodiments, the first slot, the second slot and the third slot are substantially parallel to each other. The fourth slot is substantially perpendicular to the first slot and the second slot. The fifth slot is substantially perpendicular to the second slot and the third slot.

Figure 3:
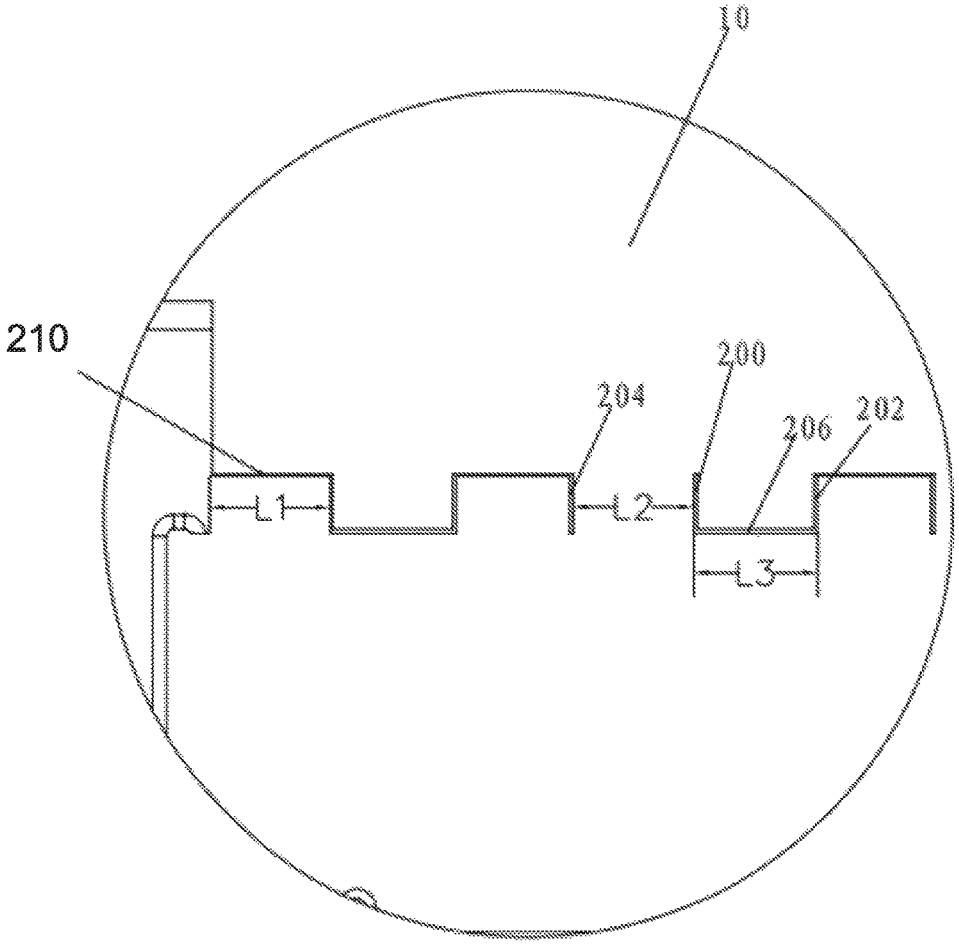
FIG. 3 is a partially enlarged view taken along circle A of FIG. 1.

In some exemplary embodiments, the slit adjacent to the first or second side of the panel is extended or truncated. By way of example, FIGS. 1 and 3 illustrate the slit adjacent to first side 17 is extended. In various cases, the extended slit includes an additional slot such as sixth slot 210 having one end connected to slit 20 and having another end extended to the first side of the panel. In some cases, the length of the additional slot (L1 in FIG. 3) is less than the sum of the distance between the adjacent slits (L2) and the length of the fourth slot (L3).

Figure 4:
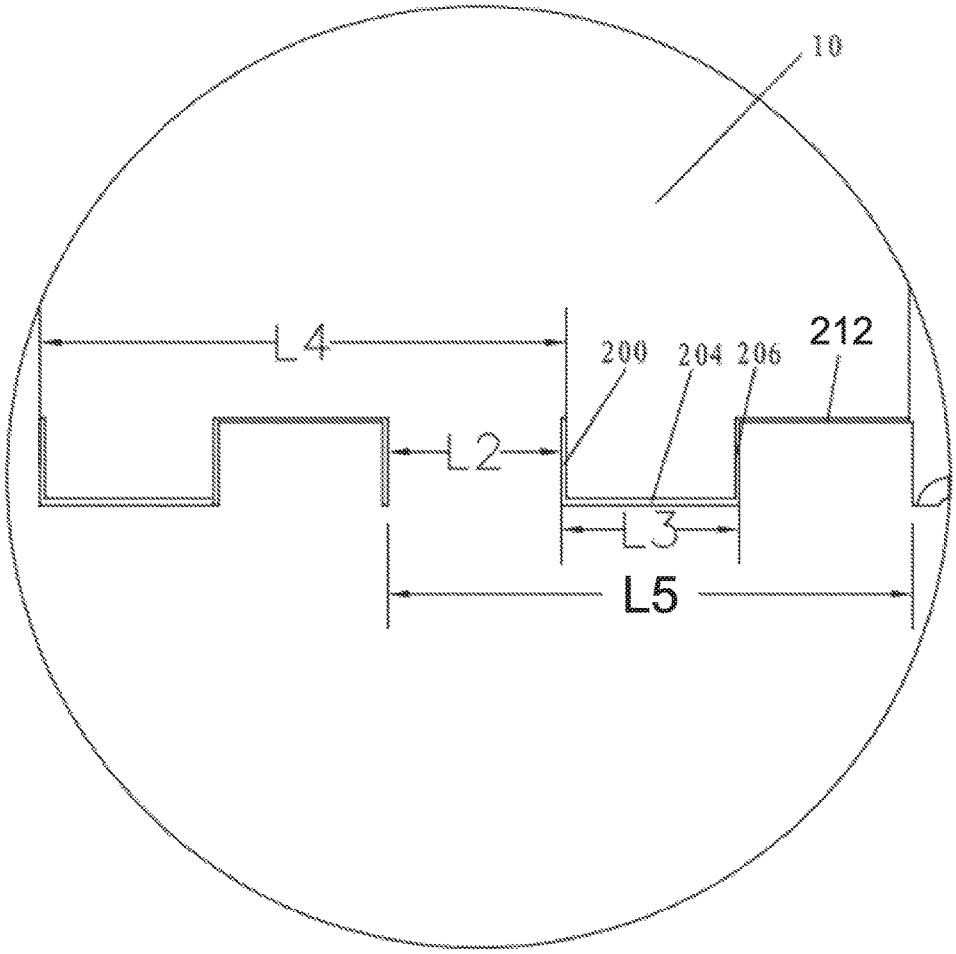
FIG. 4 is a partially enlarged view taken along circle B of FIG. 1.

As another example, FIGS. 1 and 4 illustrate the slit adjacent to second side 19 is truncated. Truncation can occur at any suitable position of the slit. In the illustrated embodiment, truncation is occurred at fifth slot 208. As such, the length of slot 212 is equal to or less than the length of fifth slot 208. Accordingly, the distance of the next adjacent slit to the second side (L5 in FIG. 4) is equal to or less than the distance between the first slots of two adjacent slits (L4).

Referring in particular to FIG. 5, when bent, panel body 101 and panel extension 102 include one or more inter-fitted protrusions and recesses (e.g., the rejoin around the plurality of slits forms protrusions and recesses). For instance, protrusion "a" is formed in panel body 101 by the first slot, the fourth slot and the second slot. Corresponding to protrusion "a" in panel body 101, a recess is formed in panel extension 102. Protrusion "a" is fitted in the recess formed in panel extension 102, with the lower surface of protrusion "a" abutting a bottom surface of the recess formed in panel extension 102. It should be noted that in some cases, the panel extension can be bent in another direction (e.g., upwardly). In such cases, it is the upper surface of protrusion "a" that abuts the bottom surface of the recess formed in panel extension 102.

Similarly, protrusion "b" is formed in panel extension 102 by the second slot, the fifth slot and the third slot. Corresponding to protrusion "b" in panel extension 102, a recess is formed in panel body 101. Protrusion "b" is fitted in the recess formed in panel body 101, with the upper or lower surface of protrusion "b" abutting a bottom surface of the recess formed in panel body 101. In some exemplary embodiments, protrusions "a" and "b" are in right-angled intersection with each other.

When bent, the first slit, the sixth slit and the first side of the panel collectively form protrusion "c" in panel extension 102. In some exemplary embodiments, protrusion "c" and its adjacent protrusion "a" are in right-angled intersection with each other. In the illustrated embodiment, when bent, the truncated slit adjacent the second side of the panel forms protrusion "d" in panel extension 102. In some exemplary embodiments, protrusion "d" and its adjacent protrusion "a" are in right-angled intersection with each other.

As disclosed herein, when bent, the upper or lower surface (depending on bending direction) of the respective protrusion abuts a bottom surface of the corresponding recess. Thus, once bent, the panel extension is stabilized and will not bounce back.

Figure 6:
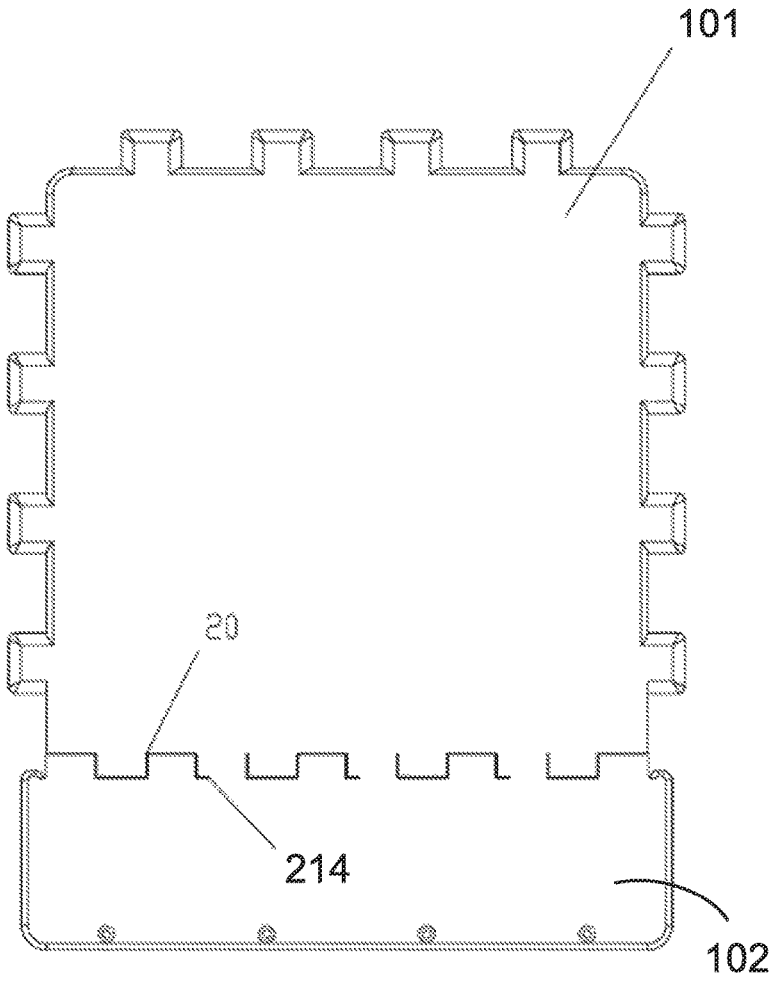
FIG. 6, FIG. 7, FIG. 8 and FIG. 9 are schematic views illustrating exemplary bendable panels including alternative or modified slits in accordance with some exemplary embodiments of the present invention.
Figure 7:
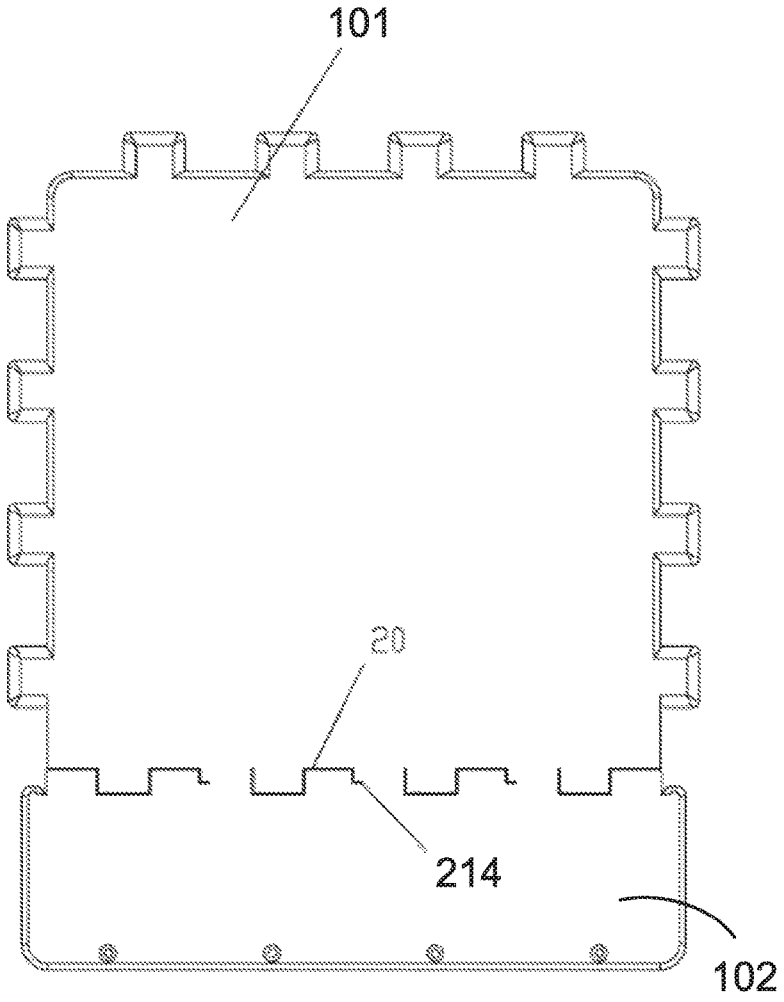

In some exemplary embodiments, slit 20 includes one or more additional slots. For instance, by way of example, FIGS. 6 and 7 illustrate slit 20 including an additional slot such as seventh slot 214. Seventh slot 214 has one end connected to a first end of third slot 204. In an exemplary embodiment, the seventh slot is substantially parallel to the fourth or fifth slot. In an exemplary embodiment, the seventh slot has a length shorter than that of the fourth or fifth slot.

The first slot, the second slot and the third slot can have substantially the same length or different lengths. For instance, FIGS. 1 and 6 illustrate the first slot, the second slot and the third slot having substantially the same length. FIG. 7 illustrates the first slot and the second slot having substantially the same length while the third slot has a different length. Similarly, the fourth slot and fifth slot can have substantially the same length or different lengths.

Figure 8:
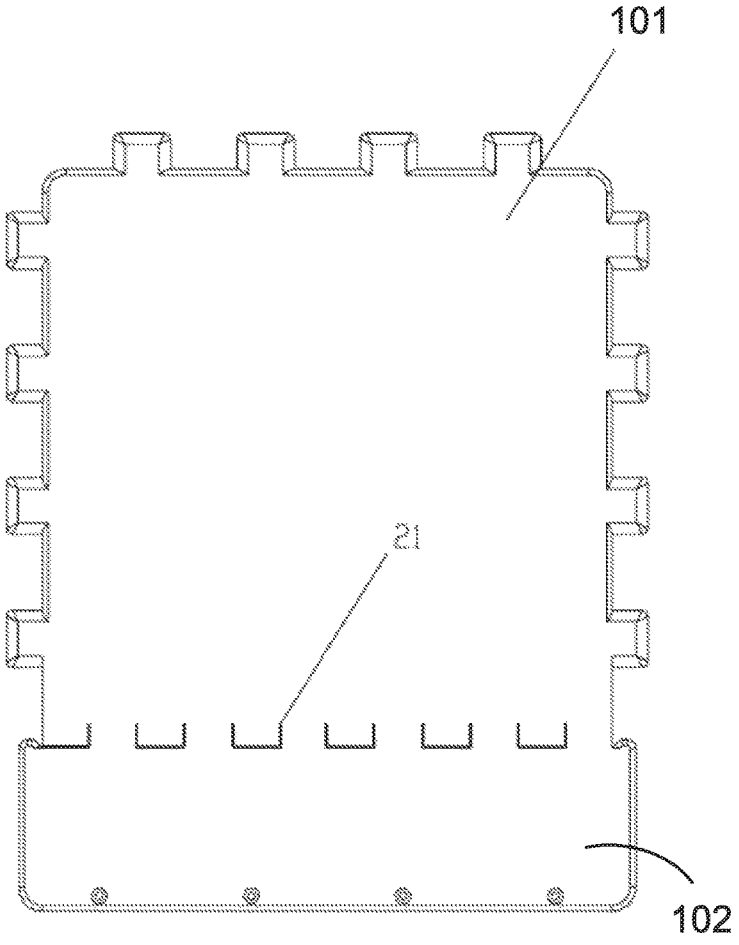
Figure 9:
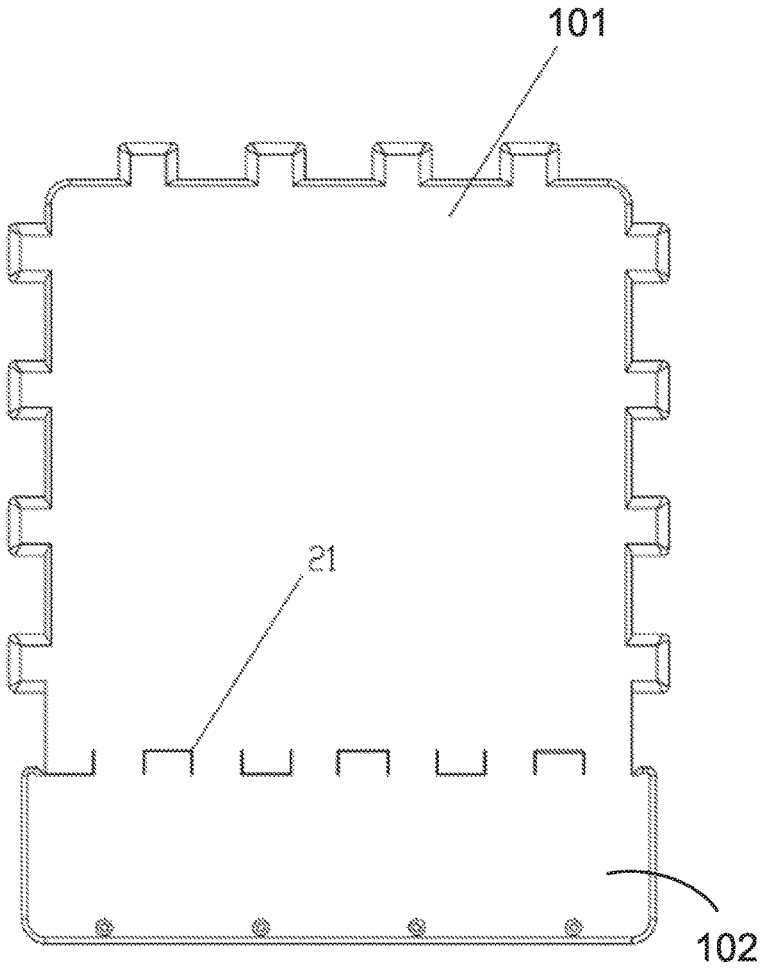

Bending lines can include different slits. For instance, referring to FIGS. 8 and 9, in some exemplary embodiments, bending line 17 includes a plurality of slits such as slits 21. Slit 21 has a substantially ⊔-shape collectively formed by three slots. The ⊔-shaped slit can be oriented in either direction, e.g., with the opening of the ⊔-shape facing up or down in the figures. As an example, FIG. 8 illustrates adjacent ⊔-shaped slits with openings facing the same direction, and FIG. 9 illustrates adjacent ⊔-shaped slits with openings facing opposite directions. In addition, by way of example, FIGS. 8 and 9 illustrate the slit adjacent to first side 18 of the panel is a truncated slit.

Figure 10:
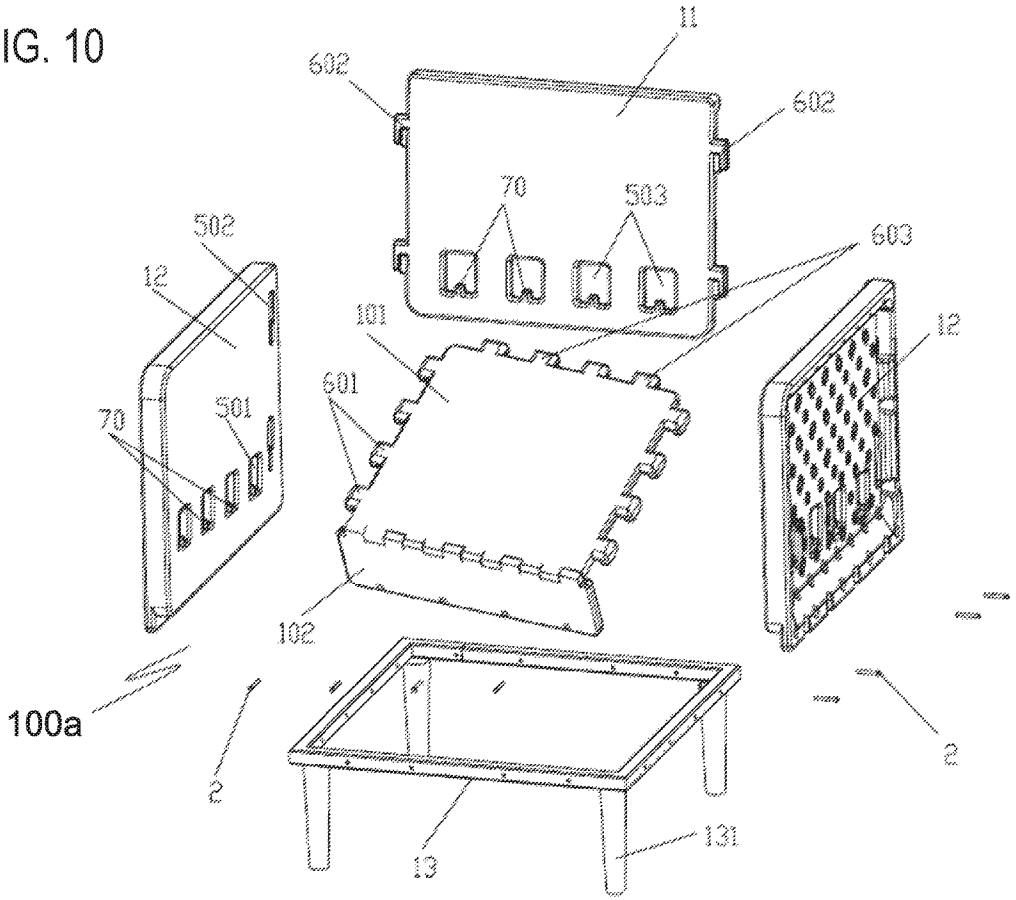
FIG. 10 is a schematic exploded view illustrating an exemplary sofa in accordance with some exemplary embodiments of the present invention.
Figure 11:
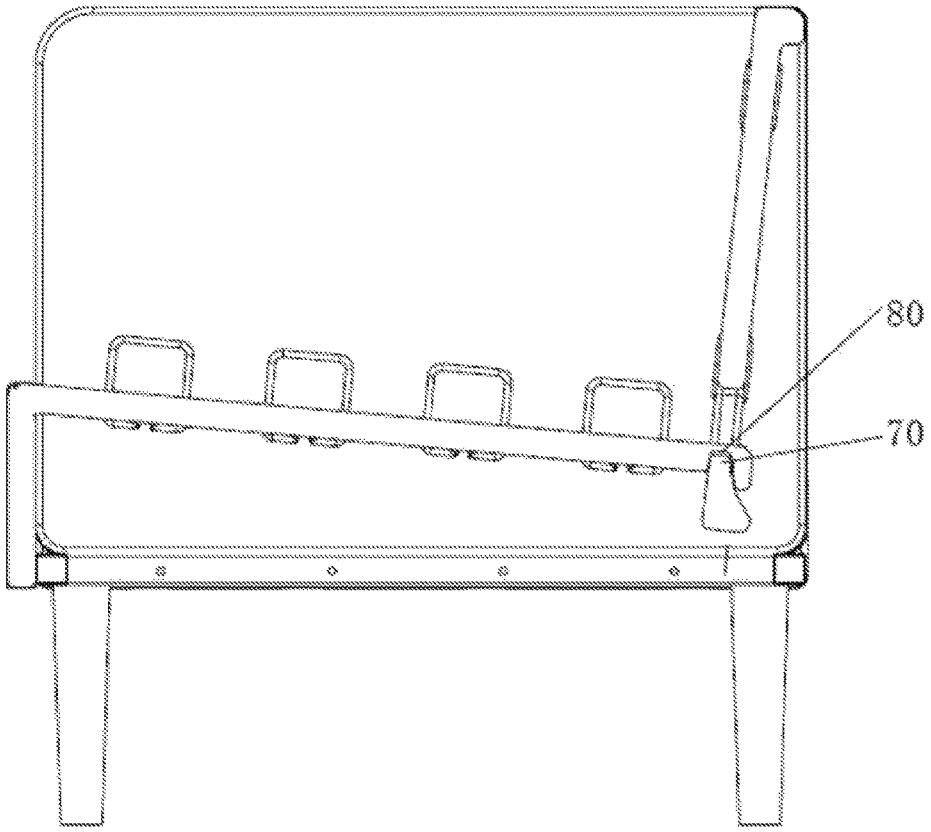
FIG. 11 is a schematic side view illustrating the exemplary sofa of FIG. 10.
Figure 12:
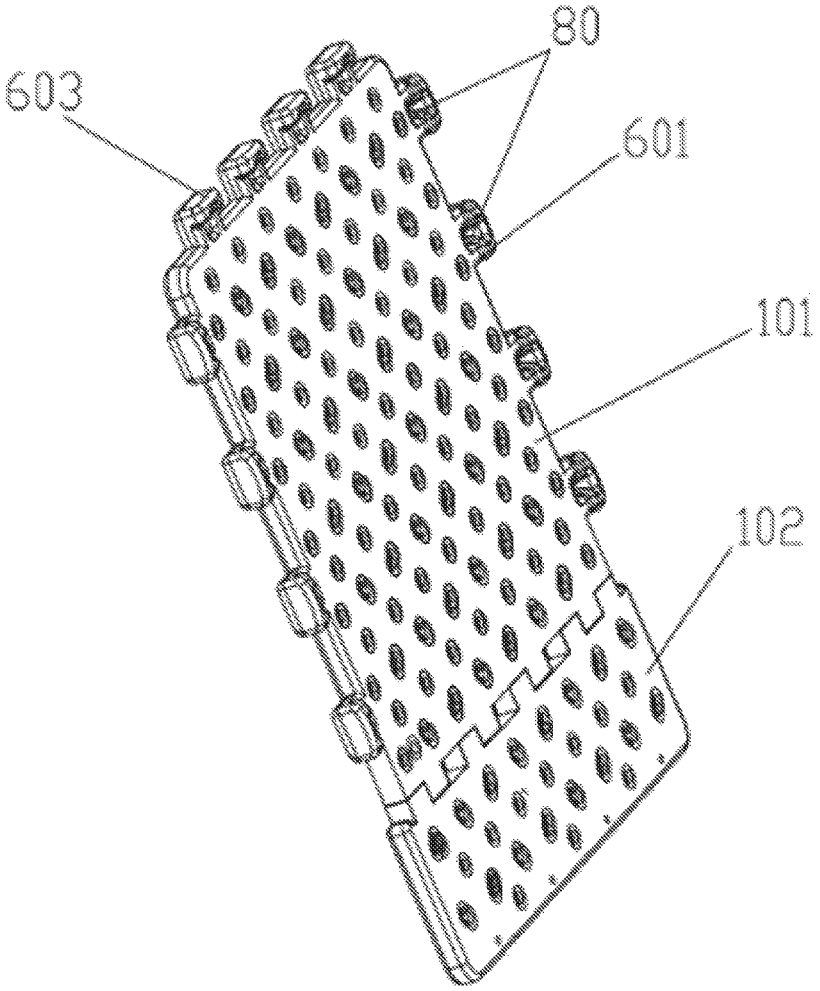
FIG. 12 is a schematic perspective view illustrating a bendable panel in accordance with some exemplary embodiments of the present invention.

The bendable panels disclosed herein can be used to make any suitable furniture. By way of example, FIGS. 10-12 illustrate the use of bendable panel 1*a* in the making of an exemplary sofa frame or sofa. As shown, exemplary sofa frame or sofa 100*a* includes a lower frame such as lower frame 13, two side panels such as left and right side panels 12, a back panel such as back panel 11, and a seat panel made of a bendable panel such as bendable panel 1*a*. Lower frame 13 is generally polygonal, and in some cases, is substantially rectangular. In some exemplary embodiments, lower frame 13 has front, rear, left and right sides, and is supported by a plurality of legs such as leg 131.

Left and right side panels 12 are disposed above the lower frame, each having a bottom side fixedly connected to the left or right side of the lower frame, for instance, by bolts 2. Back panel 11 is disposed above and at the rear side of the lower frame. The back panel has a left side connected to the left side panel and a right side connected to the right side panel. The seat panel is disposed above the lower frame, and includes a panel body such as panel body 101 and a panel extension such as panel extension 102 divided by a bending line. The left side (e.g., first side 18), the right side (e.g., second 19) and the rear side of panel body 101 is connected to the left side panel, the right side panel and the back panel. Panel extension 102 is bent downward with respect to the panel body along the bending line, and has a side fixedly connected to the front side of the lower frame.

In some exemplary embodiments, the panel body, the left side panel, the right side panel and the back panel are formed with receiving openings and snap blocks configured to couple the panel body, the left side panel, the right side panel and the back panel. For instance, in the illustrated embodiments, panel body 101 includes a first plurality of snap blocks such as snap blocks 601 at each of the left and right sides of the panel body. Corresponding to the first plurality of snap blocks, each of left and right side panels 12 includes a first plurality of receiving openings such as receiving openings 501. The first plurality of receiving openings is arranged laterally at a lower portion of the left or right side panel to couple with the first plurality of snap blocks formed at the left or right side of the panel body. Back panel 11 includes a second plurality of snap blocks such as snap blocks 602 at each of a left side and a right side of the back panel. Corresponding to the second plurality of snap blocks, each of left and right side panels 12 includes a second plurality of receiving openings such as receiving openings 502. The second plurality of receiving openings is arranged vertically at a rear portion of the left or right side panel to couple with the second plurality of snap blocks formed at the left or right side of the panel body. Panel body 101 includes a third plurality of snap blocks such as snap blocks 603 at a rear side of the panel body. Corresponding to the third plurality of snap blocks, back panel 11 includes a third plurality of receiving openings such as receiving openings 503. The third plurality of receiving openings is arranged laterally at a lower portion of the back panel to couple with the third plurality of snap blocks of the panel body.

As used herein, the term "arranged laterally" can be but does not necessarily have to be horizontal or parallel to the ground, and the term "arranged vertically" can be but does not necessarily have to be perpendicular to the ground.

Snap blocks in the first, second, and third pluralities of snap blocks can be configured the same as or different from each other. Similarly, receiving openings in the first, second and third pluralities of receiving openings can be configured the same as or different from each other. In an exemplary embodiment, one or each receiving opening in the first and third pluralities of receiving openings includes an inner protrusion such as inner protrusion 70. Corresponding to the inner protrusion, one or each snap block in the first and third pluralities of snap blocks includes a groove such as groove 80 to receive the inner protrusion. As such, when inner protrusion 70 is fitted in groove 80, it prevents unintentional disengagement of the left, right or back panel from the panel body.

Figure 13:
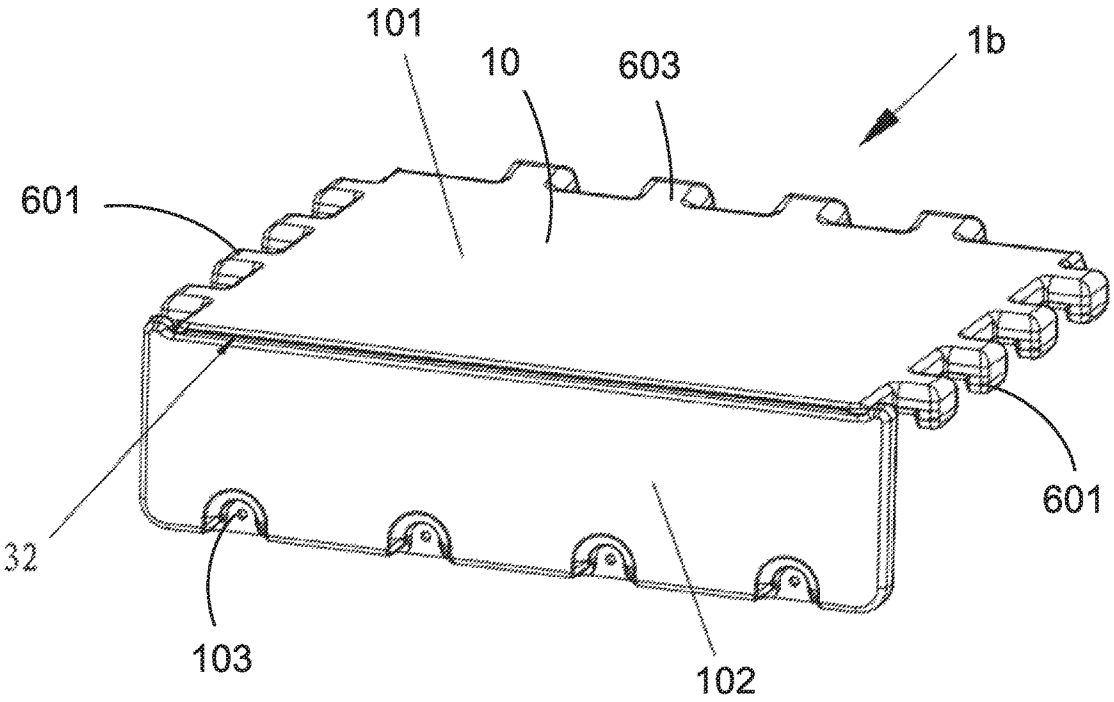
FIG. 13 is a schematic view illustrating an exemplary bendable panel in a bent state in accordance with a second exemplary embodiment of the present invention.

Bendable panels of the present invention can include differently types of bending lines, or include one or more bending lines configured differently than bending line 17. As an example, FIG. 13 illustrates exemplary bendable panel 1*b* including a crease or a crease-like bending line (e.g., first bending line 32). Like bending line 17 in exemplary bendable panel 1*a* (although configured differently), first crease or crease-like bending line 32 divides panel 10 into panel body 101 and panel extension 102, and allows panel extension 102 to bend with respect to panel body 101 upwardly, downwardly, or both upwardly and downwardly between a first angle and a second angle. In an exemplary embodiment, first crease or crease-like bending line 32 allows panel extension 102 to bend between approximately 0 degree and approximately 90 degrees. In some exemplary embodiments, panel extension 102 is formed with a plurality of holes such as screw holes 103 to couple with other components of the furniture (e.g., lower frame 13 of a sofa or a sofa frame). In some exemplary embodiments, snap blocks 601 and 603 are formed at panel body 101 to couple with other components such as side and back panels of a sofa or a sofa frame.

Figure 14:
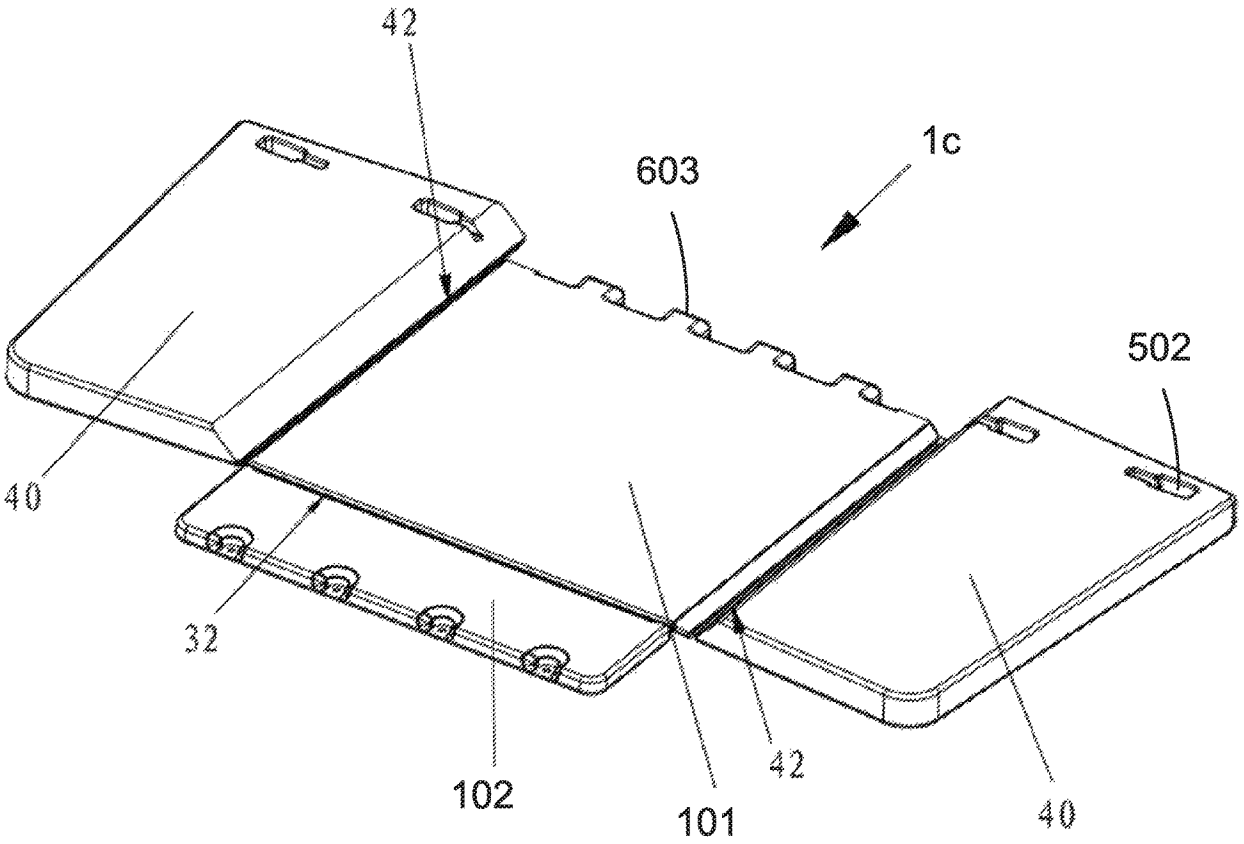
FIG. 14 is a schematic view illustrating an exemplary bendable panel in accordance with a third exemplary embodiment of the present invention.
Figure 15:
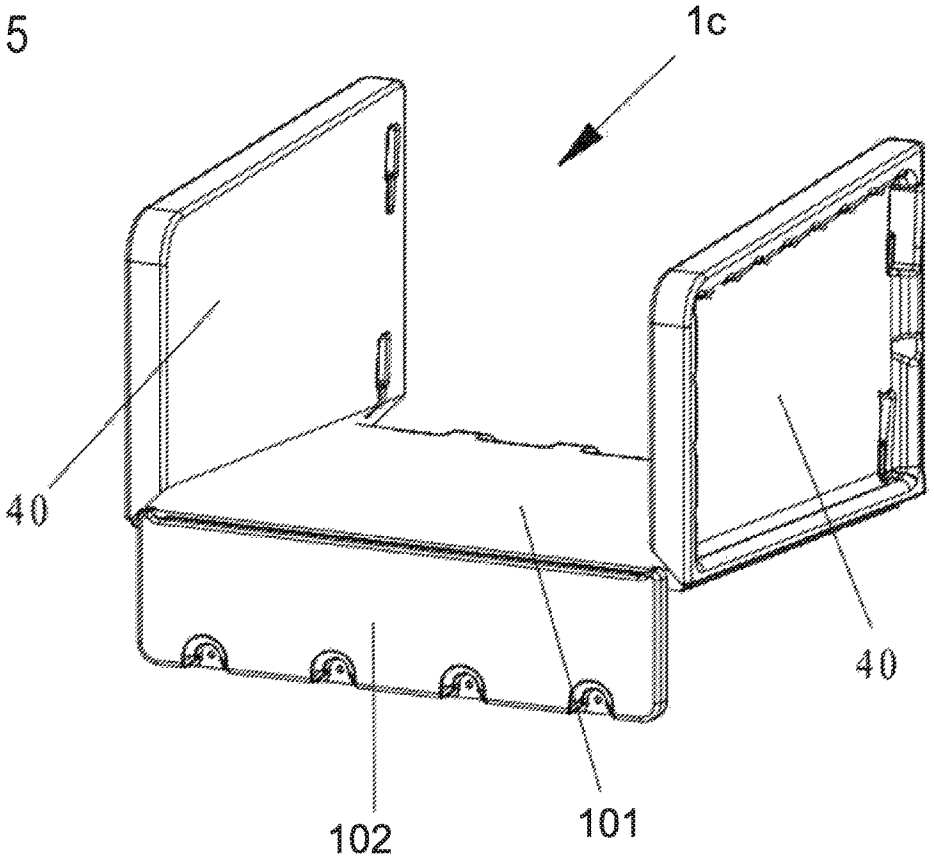
FIG. 15 is a schematic view illustrating the exemplary bendable panel of FIG. 14 in a bent state.

Bendable panels of the present invention can include more than one bending lines. As an example, FIGS. 14 and 15 illustrate exemplary bendable panel 1*c* including three bending lines such as first bending line 32 and two crease or crease-like second bending lines 42. Bending lines 32 and 42 divide panel 10 into panel body 101, panel extension 102 and two second panel extensions 40. Like bending line 32, bending lines 42 allow second panel extensions 40 to bend with respect to panel body 101 upwardly, downwardly, or both upwardly and downwardly. By way of illustration, FIG. 15 shows that panel extension 102 is bent downward along bending line 32. Second panel extensions 40 are bent upward along left and right bending lines 42, respectively. In some exemplary embodiments, receiving openings 502 are formed at the second panel extensions and snap blocks 603 are formed at panel body 101 to couple with other components such as a back panel of a sofa or a sofa frame.

Figure 16:
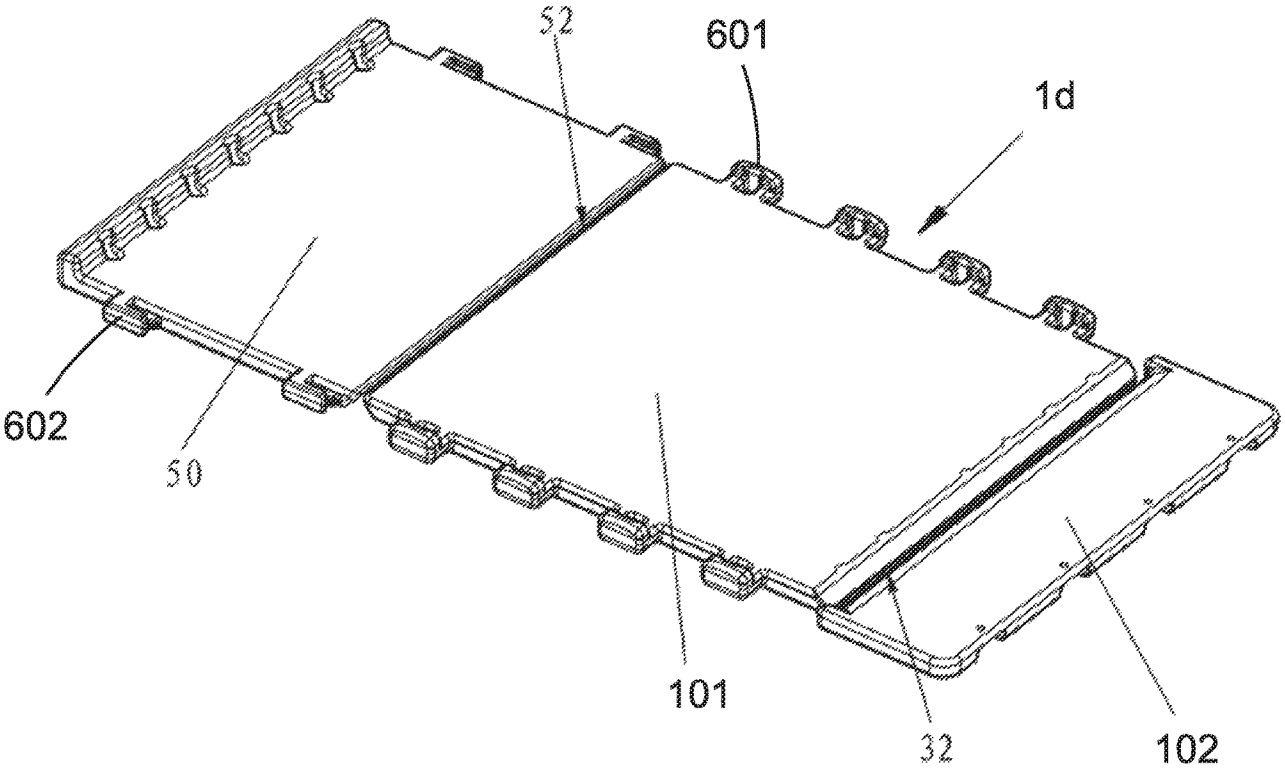
FIG. 16 is a schematic view illustrating an exemplary bendable panel in accordance with a fourth exemplary embodiment of the present invention.
Figure 17:
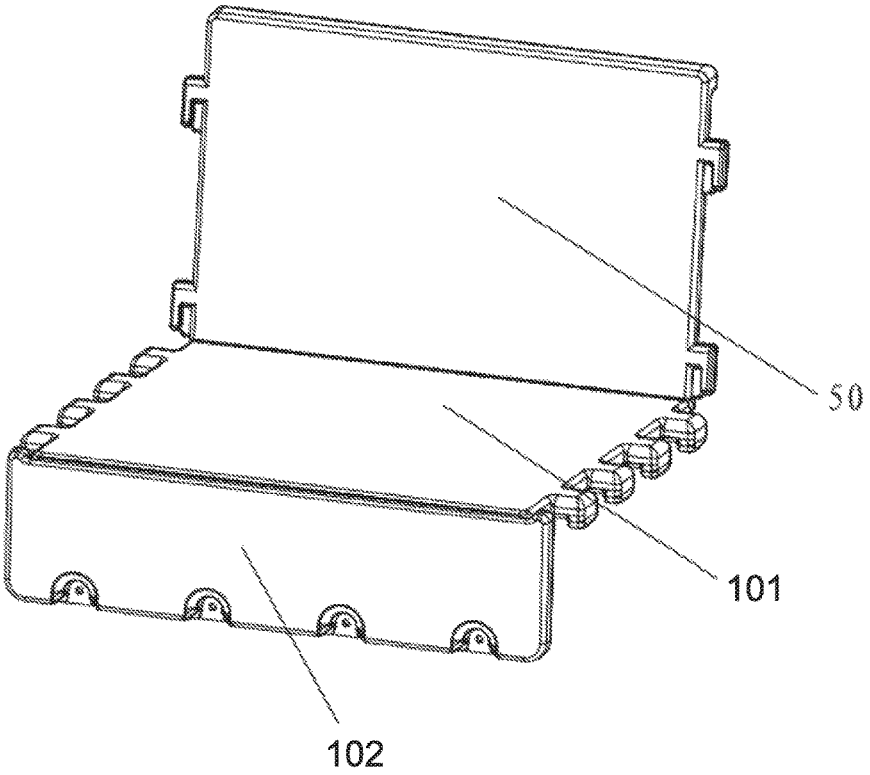
FIG. 17 is a schematic view illustrating the exemplary bendable panel of FIG. 16 in a bent state.

As another example, FIGS. 16 and 17 illustrate exemplary bendable panel 1*d* including two bending lines such as first bending line 32 and crease or crease-like third bending line 52. Bending lines 32 and 52 divide panel 10 into panel body 101, panel extension 102 and an additional panel extension such as third panel extension 50. Like other bending lines, bending line 52 allows third panel extension 50 to bend with respect to panel body 101 upwardly, downwardly, or both upwardly and downwardly. By way of illustration, FIG. 17 shows that panel extension 102 is bent downward along bending line 32, and third panel extension 50 is bent upward along bend line 52. In some exemplary embodiments, snap blocks 602 and 603 are formed at panel extension 50 and panel body 101 to couple with other components such as left and right side panels of a sofa or a sofa frame.

Figure 18:
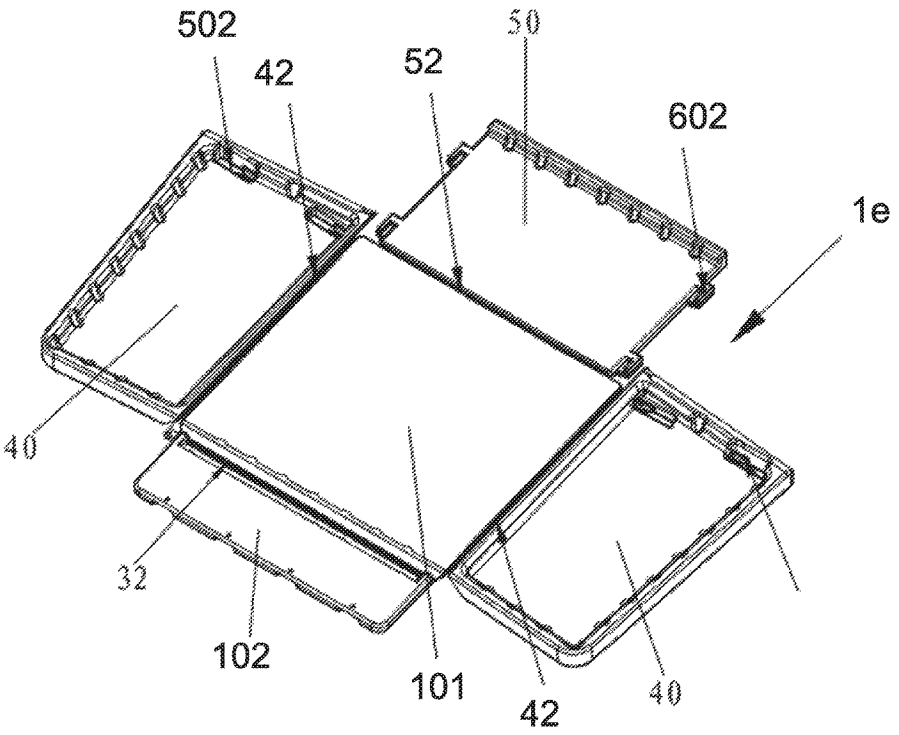
FIG. 18 is a schematic view illustrating an exemplary bendable panel in accordance with a fifth exemplary embodiment of the present invention.
Figure 19:
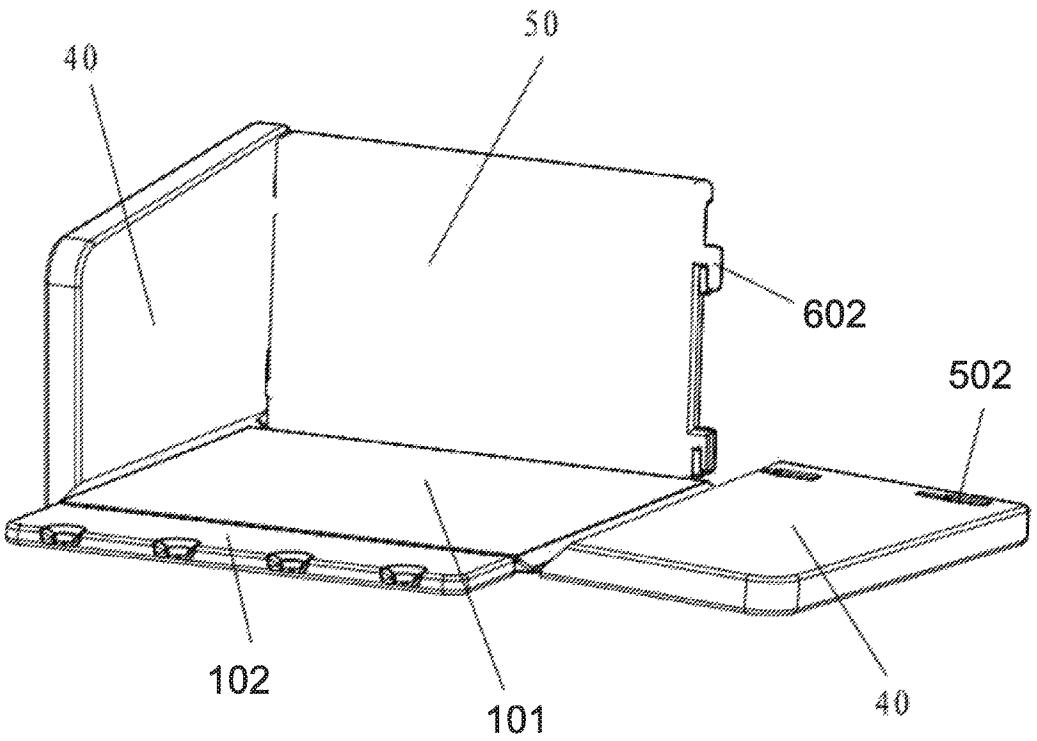
FIG. 19 is a schematic view illustrating the exemplary bendable panel of FIG. 18 in a bent state.

As a further example, FIGS. 18 and 19 illustrate exemplary bendable panel 1*e* including four bending lines such as first bending line 32, two second bending lines 42 and third bending lines 52. Bending lines 32, 42 and 52 divide panel 10 into panel body 101, panel extension 102, second panel extensions 40 and third panel extension 50. Panel extension 102, second panel extensions 40 and third panel extension 50 are bendable along bending lines 32, 42 and 52 with respect to panel body 101 upwardly, downwardly, or both upwardly and downwardly. By way of illustration, FIG. 19 shows that panel extension 102 is bent downward, while second panel extensions 40 and third panel extension 50 are bent upward. In some exemplary embodiments, receiving openings 502 are formed at second panel extensions 40, and corresponding snap blocks 603 are formed at third panel extension 50 to couple with receiving openings 502 of the side panels.

Figure 20:
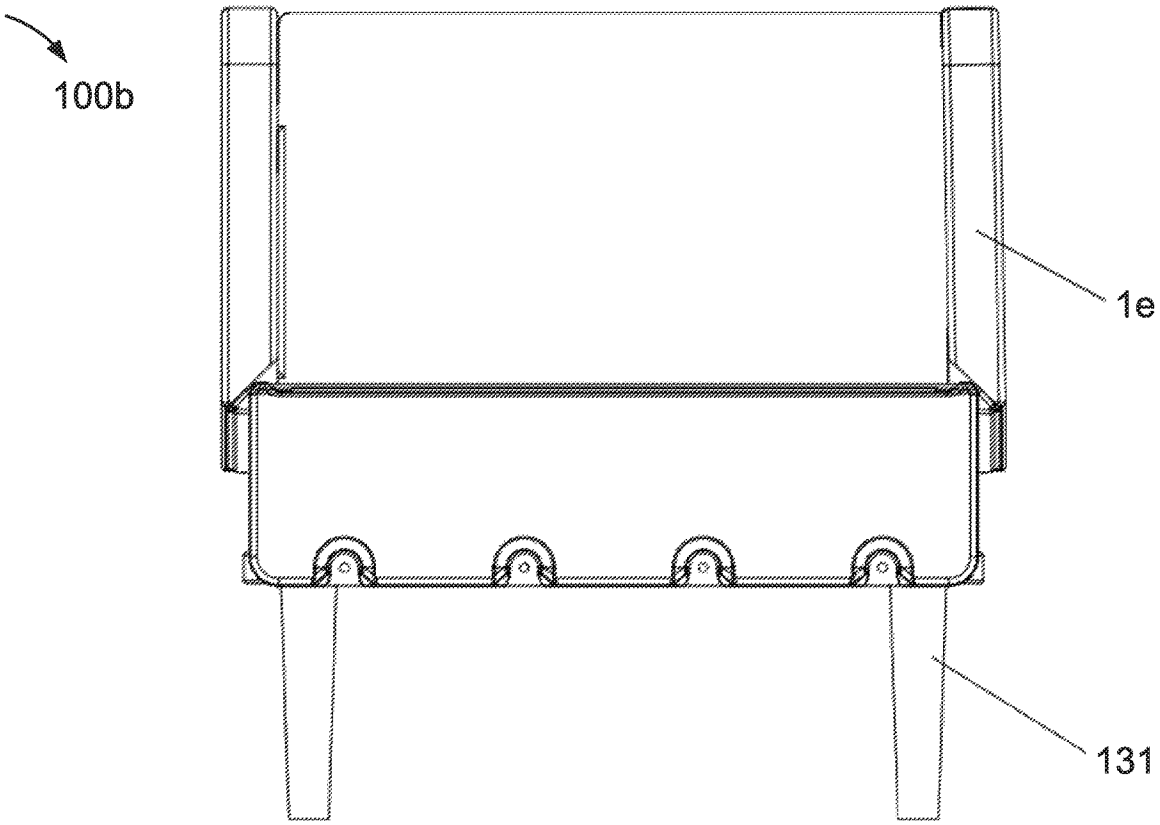
FIG. 20 is a schematic front view illustrating an exemplary sofa including the exemplary bendable panel of FIG. 18 in accordance with some exemplary embodiments of the present invention.
Figure 21:
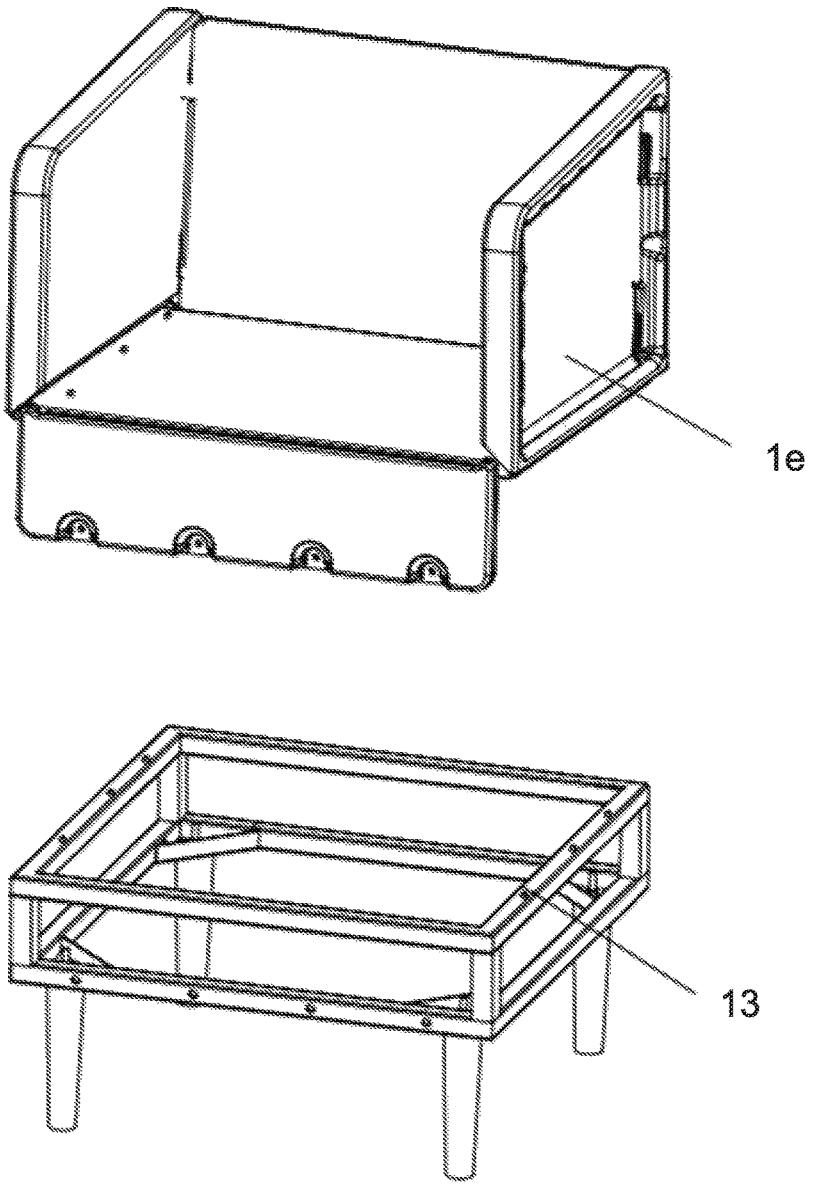
FIG. 21 is a partially exploded view illustrating the exemplary sofa of FIG. 20.

Like exemplary bendable panel 1*a*, exemplary bendable panels 1*b*-1*e* of the present invention can be used to make any suitable furniture. By way of example, FIGS. 20 and 21 illustrate the use of bendable panel 1*e* to make an exemplary sofa frame or sofa. As shown, exemplary sofa frame or sofa 100*b* includes a lower frame such as lower frame 13 and bendable panel 1*e* coupled to the lower frame. Panel body 101 of bendable panel 1*e* is used as the seat panel, while panel extension 102 is fixedly connected to the front side of lower frame 13. Second panel extensions 40 are used as left and right side panels 12, and third panel extension 50 as back panel 11.

The bendable panels, the sofa frames and the sofas of the present invention have several advantages. For instance, the one or more panel extensions of a bendable panel of the present invention are formed integrally with the panel body and can be bent easily along the one or more bending lines. When bent, the one or more panel extensions will not bounce back. As such, assembling and disassembling the furniture made of the bendable panels of the present invention are easy, and can be performed rapidly with less working intensity. Using the bendable panels of the present invention also reduces the production cost of the furniture, and prevents potential working-related injury. In various cases, the bendable panels are made of plastics, and thus moisture has little effect on the furniture composed of the bendable panels. In many cases, the bendable panels are hollow, further reducing the consumption of the raw material, the cost of the furniture and the cost of shipping and transportation. In addition, disassembled panels are convenient for storage and transportation.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "left" and "right", "upward" and "downward" etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first slot could be termed a second slot, and, similarly, a second slot could be termed a first slot, without changing the meaning of the description, so long as all occurrences of the "first slot" are renamed consistently and all occurrences of the "second slot" are renamed consistently.

What is claimed is:

1. A bendable panel for furniture, comprising:

a panel formed with one or more bending lines, wherein the one or more bending lines divide the panel into a panel body and one or more panel extensions; and a respective panel extension in the one or more panel extensions is bendable with respect to the panel body along a corresponding bending line in the one or more bending lines between a first angle and a second angle, wherein:

the one or more panel extensions comprises a first panel extension;

the one or more bending lines comprises a first bending line between the panel body and the first panel extension; and the first bending line comprises a plurality of slits, wherein (i) adjacent slits are spatially separated from each other;

(ii) each slit in the plurality of slits comprises a plurality of slots;

(iii) adjacent slots in the plurality of slots are connected to each other at ends thereof; and (iv) when the first panel extension is bent with respect to the panel body along the first bending line at the second angle, the first bending line produces one or more inter-fitted protrusions and recesses at the first panel extension and the panel body, with an upper or lower surface of the panel body at a respective protrusion abutting a bottom surface of a corresponding recess.

2. The bendable panel of claim 1, wherein the panel is formed with up to four bending lines, which divide the panel into the panel body and up to four panel extensions.

3. The bendable panel of claim 1, wherein the panel or the panel body is hollow.

4. The bendable panel of claim 1, wherein the panel is molded by a drawing or blowing process.

5. The bendable panel of claim 1, wherein the panel body has a substantially rectangular shape.

6. The bendable panel of claim 1, wherein the respective panel extension is bendable with respect to the panel body along the corresponding bending line between approximately 0 degree and 90 degrees.

7. The bendable panel of claim 1, wherein a respective slit in the plurality of slits comprises a first slot, a second slot, a third slot, a fourth slot and a fifth slot, wherein:

the first, second and third slots are arranged at intervals;

the fourth slot is disposed between the first and second slots, and having a first end connected to a first end of the first slot and a second end connected to a first end of the second slot; and the fifth slot is disposed between the second and third slots, and having a first end connected to a second end of the second slot and a second end connected to a second end of the third slot.

8. The bendable panel of claim 7, wherein:

the first slot, the second slot and the third slot are substantially parallel to each other;

the fourth slot is substantially perpendicular to the first slot and the second slot; and the fifth slot is substantially perpendicular to the second slot and the third slot.

9. The bendable panel of claim 7, wherein the respective slit in the plurality of slits is adjacent to a side of the panel, and further comprises a sixth slot, wherein the sixth slot has a first end connected to a second end of the first slot and a second end extended to the side of the panel.

10. The bendable panel of claim 9, wherein the sixth slot is substantially aligned with the fifth slot.

11. The bendable panel of claim 9, wherein the sixth slot has a length less than the sum of a distance between two adjacent slits and a length of the fourth slot.

12. The bendable panel of claim 7, wherein the respective slit in the plurality of slits is adjacent to a side of the panel, and is truncated.

13. The bendable panel of claim 12, wherein a distance of the next adjacent slit to the side of the panel is equal to or less than a distance between the first slots of two adjacent slits.

14. The bendable panel of claim 7, wherein the respective slit in the plurality of slits further comprises a seventh slot having a first end connected to a first end of the third slot.

15. The bendable panel of claim 14, wherein the seventh slot is substantially parallel to the fourth or fifth slot.

16. The bendable panel of claim 14, wherein the seventh slot has a length shorter than that of the fourth or fifth slot.

17. The bendable panel of claim 7, wherein lengths of the first slot, the second slot and the third slot are substantially the same, and lengths of the fourth slot and the fifth slot are substantially the same.

18. The bendable panel of claim 7, wherein lengths of the first slot and the second slot are substantially the same, and a length of the third slot is different than the lengths of the first slot and the second slot.

19. The bendable panel of claim 1, wherein a respective slit in the plurality of slits comprises three slots collectively forming a truncated-rectangular-shaped slit.

20. The bendable panel of claim 1, wherein the plurality of slits comprises two or more truncated-rectangular-shaped slits, with openings of adjacent truncated-rectangular-shaped slits facing the same direction.

21. The bendable panel of claim 1, wherein the plurality of slits comprises two or more truncated-rectangular-shaped slits, with openings of adjacent truncated-rectangular-shaped slits facing opposite directions.

22. The bendable panel of claim 1, wherein the one or more bending lines comprises a second bending line that is a crease.

23. A sofa comprising:

a lower frame having a front side, a rear side, a left side and a right side; and a bendable panel coupled to the lower frame, the bendable panel comprising a panel body and a first panel extension divided by a first bending line, wherein the panel body serves as a seat panel of the sofa;

the first panel extension is bent downward with respect to the panel body along the first bending line, and has a side fixedly connected to the front side of the lower frame; and the first bending line comprises a plurality of slits configured such that when bent, the panel extension and the panel body comprise one or more inter-fitted protrusions and recesses, with a lower surface of the seat panel at a respective protrusion abutting a bottom surface of a corresponding recess, wherein:

adjacent slits are spatially separated from each other;

each slit in the plurality of slits comprises a plurality of slots; and adjacent slots in the plurality of slots are connected to each other at ends thereof.

24. The sofa of claim 23, wherein a respective slit in the plurality of slits comprises a first slot, a second slot, a third slot, a fourth slot and a fifth slot, wherein:

the first, second and third slots are arranged at intervals;

the fourth slot is disposed between the first and second slots, and having a first end connected to a first end of the first slot and a second end connected to a first end of the second slot; and the fifth slot is disposed between the second and third slots, and having a first end connected to a second end of the second slot and a second end connected to a second end of the third slot.

25. The sofa of claim 24, wherein the respective slit in the plurality of slits is adjacent to a side of the panel, and further comprises a sixth slot, wherein the sixth slot has a first end connected to a second end of the first slot and a second end extended to the side of the panel.

26. The sofa of claim 24, wherein the respective slit in the plurality of slits is adjacent to a side of the panel, and is truncated.

27. The sofa of claim 24, wherein the respective slit in the plurality of slits further comprises a seventh slot having a first end connected to a first end of the third slot.

28. The sofa of claim 23, wherein a respective slit in the plurality of slits comprises three slots collectively forming a truncated-rectangular-shaped slit.

29. The sofa of claim 23, wherein the bendable panel further comprises two second bending lines dividing the panel into the panel body and two second panel extensions, wherein each of the two second panel extensions is bent upward and serves as a left or right side panel of the sofa.

30. A sofa comprising:

a lower frame having a front side, a rear side, a left side and a right side;

a bendable panel coupled to the lower frame, the bendable panel comprising a panel body and a first panel extension divided by a first bending line, wherein the panel body serves as a seat panel of the sofa;

the first panel extension is bent downward with respect to the panel body along the first bending line, and has a side fixedly connected to the front side of the lower frame;

a left side panel disposed above the lower frame and having a bottom side fixedly connected to the left side of the lower frame;

a right side panel disposed above the lower frame and having a bottom side fixedly connected to the right side of the lower frame; and a back panel disposed above and at the rear side of the lower frame, the back panel having a left side connected to the left side panel and a right side connected to the right side panel.

31. The sofa of claim 30, wherein the panel body comprises a left side coupled to the left side panel, a right side coupled to the right side panel, and a rear side coupled to the back panel.

32. The sofa of claim 30, wherein the back panel has a left side coupled to the left side panel and a right side coupled to the right side panel.

33. The sofa of claim 30, wherein:

the panel body comprises a first plurality of snap blocks at each of a left side and a right side of the panel body, and each of the left and right side panels comprises a first plurality of receiving openings arranged laterally at a lower portion of the left or right side panel to couple with the first plurality of snap blocks formed at the left or right side of the panel body;

the back panel comprises a second plurality of snap blocks at each of a left side and a right side of the back panel, and each of the left and right side panels comprises a second plurality of receiving openings arranged vertically at a rear portion of the left or right side panel to couple with the second plurality of snap blocks formed at the left or right side of the panel body; and the panel body comprises a third plurality of snap blocks at a rear side of the panel body, and the back panel comprises a third plurality of receiving openings arranged laterally at a lower portion of the back panel to couple with the third plurality of snap blocks of the panel body.

34. The sofa of claim 33, wherein a respective receiving opening in the first or third plurality of receiving openings comprises an inner protrusion, and a corresponding snap block in the first or third plurality of snap blocks comprises a groove to receive the inner protrusion, thereby preventing unintentional disengagement of the left, right or back panel from the panel body.

35. A sofa comprising:

a lower frame having a front side, a rear side, a left side and a right side; and a bendable panel coupled to the lower frame, the bendable panel comprising a panel body and a first panel extension divided by a first bending line, wherein the panel body serves as a seat panel of the sofa; and the first panel extension is bent downward with respect to the panel body along the first bending line, and has a side fixedly connected to the front side of the lower frame;

wherein the bendable panel further comprises a third bending line dividing the panel into the panel body and a third panel extension, wherein the third panel extension is bent upward and serves as a back panel of the sofa.

36. A sofa comprising:

a lower frame having a front side, a rear side, a left side and a right side; and a bendable panel coupled to the lower frame, the bendable panel comprising a panel body and a first panel extension divided by a first bending line, wherein the panel body serves as a seat panel of the sofa; and the first panel extension is bent downward with respect to the panel body along the first bending line, and has a side fixedly connected to the front side of the lower frame;

wherein the bendable panel further comprises:

two second bending lines dividing the panel into the panel body and two second panel extensions; and a third bending line dividing the panel into the panel body and a third panel extension, wherein each of the two second panel extensions is bent upward and serves as a left or right side panel of the sofa;

the third panel extension is bent upward and serves as a back panel of the sofa; and the third panel extension is coupled to each of the two second panel extensions through receiving openings and snap blocks.

* * * * *